US005926864A

United States Patent [19]

Lynch

[11] Patent Number: 5,926,864

[45] Date of Patent: Jul. 27, 1999

[54] MUSICAL POTTY CHAIR

[76] Inventor: Beverly R. Lynch, 4655 Paloma Ave., San Jose, Calif. 95111

[21] Appl. No.: 09/139,046

[22] Filed: Aug. 24, 1998

[51] Int. Cl.[6] ..... A47K 11/00

[52] U.S. Cl. ..... 4/483; 4/902

[58] Field of Search ..... 4/902, 449, 314, 4/479, 483, DIG. 5, 661

[56] References Cited

U.S. PATENT DOCUMENTS

| | | | |
|---|---|---|---|
| 2,802,444 | 8/1957 | Gilmour | 4/902 |
| 3,364,478 | 1/1968 | Dee Waard | 4/902 |
| 3,401,408 | 9/1968 | Buck | 4/902 |
| 5,369,820 | 12/1994 | Blount | 4/902 |
| 5,535,456 | 7/1996 | Chai | 4/902 |
| 5,575,021 | 11/1996 | Harris | 4/902 |

*Primary Examiner*—Charles R. Eloshway

[57] ABSTRACT

A Musical Potty Chair comprising a chair structure having an opening in the seat portion thereby accessing a urine and/or feces collecting container whose bottom is raised at the front end and lowered at the rear end. A pressure switch located under the bottom rear of the collecting container activates when the container is filled with any amount of urine or feces. A resilient pad or other spring member holds the container up so that the pressure switch is not activated by the weight of the container alone but only by the weight of urine or feces. An electronic circuit including a microprocessor which contains a musical song, a speaker and amplifying means for making the song audible and a power supply are located in the base of the chair. An alternate embodiment includes a microprocessor which contains multiple musical songs or other sounds such as that of people cheering and the means for the user to select which sound is heard or, for the songs or sounds to be selected randomly.

2 Claims, 1 Drawing Sheet

MUSICAL POTTY CHAIR

BACKGROUND OF THE INVENTION

This invention relates generally to the field of toilet training devices generally known as potty chairs, and more particularly to a musical Potty Chair.

It has been a tradition for many years for parents or other adults to use special toilet devices while training very young children to urinate or defecate in a toilet rather than in their diapers or other locations.

To this end a device commonly known as a "potty chair" has been developed and is currently in wide use in the United States and other countries. These chairs are small in size so that a child will feel comfortable on them. They have a generally circular aperture in the seat portion which allows access to an open topped container which may be integrated with the seat top or may be separate and removable. After the child successfully completes the task of urinating or defecating, the parent or other older attendant removes and empties the container and replaces it thereby getting the potty chair ready for its next use.

Although current potty chairs are generally adequate in helping to train a small child to use a toilet, there is one disadvantage to existing designs which I have observed. After a child has successfully used a potty chair it is customary for the attending adult to give praise to the child to reinforce their behavior. This praise also makes the learning experience more fun and rewarding. Although an adults praise is rewarding, it would be even more rewarding if the child heard an additional rewarding sound such as the playing of a musical song or other appropriate audio response such as the sound of people cheering. Additionally there may be times when a small child is advanced enough to use the potty chair unattended. In this situation it would be advantageous to have a rewarding sound upon successful completion regardless of whether or not an attendant is in the vicinity.

SUMMARY OF THE INVENTION

The primary object of the invention is to provide a better potty chair that plays a musical song or other rewarding sound after a child has successfully used the chair. An alternate object is to provide a better potty chair that is capable of playing a variety of songs or sounds, as set by the attendant or offered randomly, after a child has successfully used the chair.

Other objects and advantages of the present invention will become apparent from the following descriptions, taken in connection with the accompanying drawings, wherein, by way of illustration and example, an embodiment of the present invention is disclosed.

A musical potty chair comprising: a chair structure having an opening in the seat portion thereby accessing a urine and or feces collecting container whose bottom is raised at the front end and lowered at the rear end. A pressure switch located under the bottom rear of said collecting container activates when said container is filled with any amount of urine or feces. A resilient pad or other spring member holds the container up so that the pressure switch is not activated by the weight of the container alone. An electronic circuit including a microprocessor which contains a musical song, a speaker and amplifying means for making the song audible, and a power supply are located in the bottom portion of the chair. An alternate embodiment includes a microprocessor containing multiple songs or other sounds such as the sound of a crowd cheering and a means for the user to select the desired sound. Alternately, the sounds or songs can be random in sequence and not pre selected by the attendant. In this way, a child will receive additional positive reinforcement in the form or a sound or musical song after he or she successfully uses the potty chair of the present invention.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
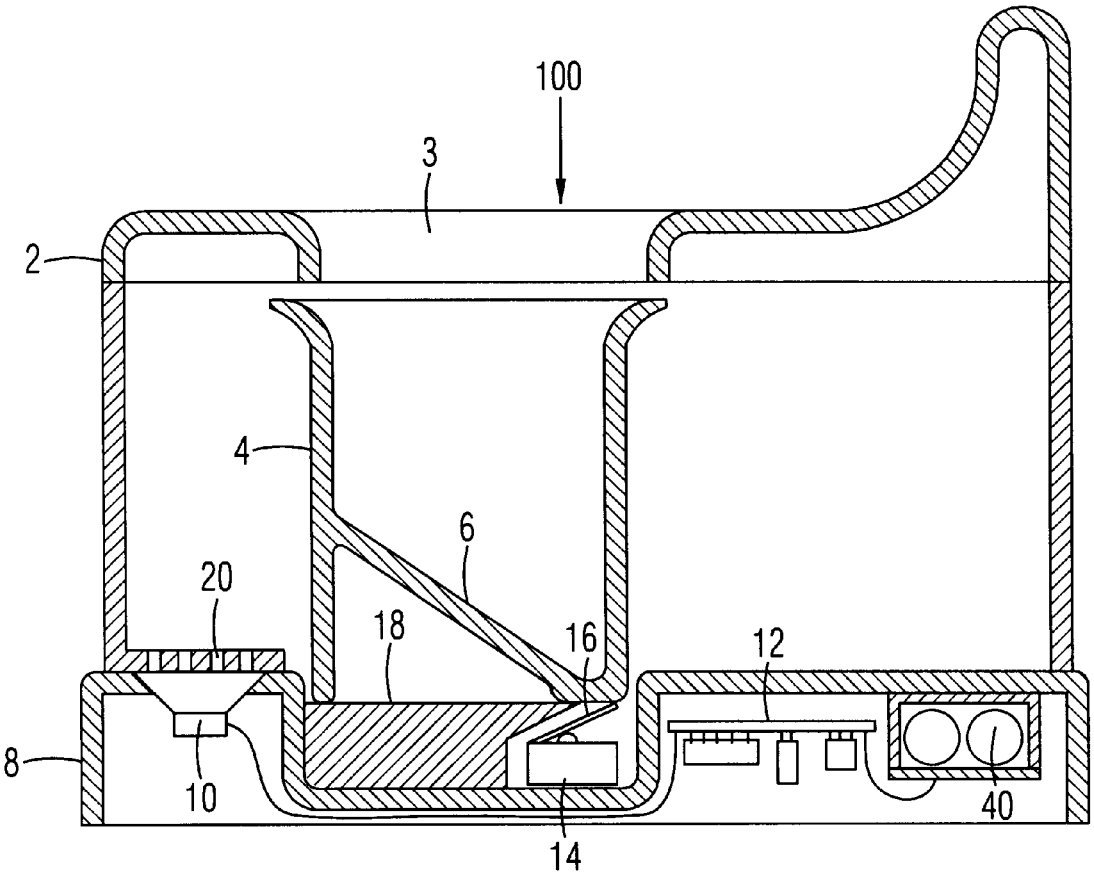
FIG. 1 is a cross section view of the potty chair of the present invention.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Referring now to FIG. 1 we see a cross section view of the potty chair of the present invention 100. Chair seat 2 is molded of rigid plastic and has an opening 3 which allows urine or feces to drop into an open topped container 4 below. Container 4 has a slanted bottom 6 so that urine or feces will travel to the far end of the container 4. Container 4 is removable and, when in the use position, is placed on a resilient pad 18 which can be made of a closed cell foam or other resilient material. Alternately, an open coiled spring can provide the needed resilience. The upward resilience caused by the foam or spring holds container 4 up to the point where it does not cause actuating lever 16 to be pressed. In other words, resilient pad 18 causes container 4 to have zero weight as it relates to pressure switch 14 and its activation lever 16. When even the smallest amount of urine is collected by container 4, it proceeds to the rear bottom of the container where the additional weight causes switch lever 16 to be pressed down thereby closing normally open switch 16. The closing of switch 16 completes a circuit whereby a micro processor located on printed circuit board 12 sends a series of amplified signals to speaker 10 thereby causing a musical song or other sound to be heard as the sound passes through holes 20 located in the base portion 8 of potty chair 100. Batteries 40 provide power for printed circuit 12 and associated speaker 10. When the child has successfully used the potty chair 100, the attendant can remove and clean container 4 thereby causing switch lever 16 to raise which resets the electronic song device 12 so that it is ready for the next use.

Alternately, a printed circuit board and associated electronics could be designed to produce a variety of songs and or other sounds such as that of people cheering the attendant could select the song or sound in advance of its use or the song or sounds could be played in a random sequence.

In the above described way a child who is learning to be toilet trained would receive additional positive reinforcement in the form or a musical song or other sound whether or not an adult is in attendance.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A potty chair, comprising:

a seat;

a base portion supporting said seat, said base portion having a depression in a lower wall thereof;

a collecting container positioned under said seat and in said depression for collecting feces and/or urine, said collecting container being movable relative to said seat and including a bottom surface which is sharply slanted for funneling said feces and/or urine downwardly to concentrate it in a lowermost point of said collecting container;

a resilient pad positioned in said depression and supporting said collecting container thereon; and a pressure switch positioned beneath said lowermost point, said resilient pad biasing said collecting container upward above the level of said pressure switch when said collecting container is empty and enabling downward movement of said collecting container upon receipt of urine and/or feces therein such that said lowermost point of said collecting container contacts said pressure switch for activating a rewarding means for rewarding a child using the potty chair successfully.

2. An audio potty chair, comprising:

a seat;

a base portion supporting said seat, said base portion having a depression in a lower wall thereof;

a collecting container positioned under said seat and in said depression for collecting feces and/or urine, said collecting container being movable relative to said seat and including a bottom surface which is sharply slanted for funneling said feces and/or urine downwardly to concentrate it in a lowermost point of said collecting container;

a resilient pad positioned in said depression and supporting said collecting container thereon;

a pressure switch positioned beneath said lowermost point, said resilient pad biasing said collecting container upward above the level of said pressure switch when said collecting container is empty and enabling downward movement of said collecting container upon receipt of urine and/or feces therein such that said lowermost point of said collecting container contacts said pressure switch;

an audio circuit board connected to said pressure switch; and a speaker connected to said audio circuit board, said audio circuit board being activated by depression of said pressure switch upon receipt of urine and/or feces in said collecting container to activate said speaker to play music therethrough for rewarding a child using the potty chair successfully.

* * * * *